United States Patent [19]

Tash et al.

[11] Patent Number: 4,963,073

[45] Date of Patent: Oct. 16, 1990

[54] WATER PRESSURE OPERATED WATER PUMP

[76] Inventors: George Tash, 5777 Balcom Canyon, Somis, Calif. 93021; Warren Hartmann, 337 Emma Ave., Ventura, Calif. 93003

[21] Appl. No.: 275,858

[22] Filed: Nov. 25, 1988

[51] Int. Cl.[5] ..... F04F 5/44

[52] U.S. Cl. ..... 417/181; 417/151

[58] Field of Search ..... 417/54, 151, 181

[56] References Cited

U.S. PATENT DOCUMENTS

| | | | |
|---|---|---|---|
| 41,158 | 1/1864 | Landsell | 417/151 |
| 1,068,102 | 7/1913 | Brown | 417/181 |
| 1,643,025 | 9/1927 | Meggenhafen | 417/181 |
| 1,950,172 | 3/1934 | Gaviaza | 417/181 |
| 2,231,090 | 2/1941 | Ross | 417/54 |
| 2,397,295 | 3/1946 | Scott | 417/181 |
| 2,575,513 | 11/1951 | Fox | 417/151 |
| 2,908,227 | 10/1959 | McDougall | 417/181 |
| 3,046,900 | 7/1962 | Pollak | 417/423.3 |
| 4,218,195 | 8/1980 | Shure | 417/423.3 |
| 4,632,649 | 12/1986 | Segebrecht et al. | 417/151 |
| 4,898,517 | 2/1990 | Eriksen | 417/151 |

FOREIGN PATENT DOCUMENTS

| | | | |
|---|---|---|---|
| 0257834 | 3/1988 | European Pat. Off. | 417/151 |
| 625733 | 8/1927 | France | 417/151 |
| 346109 | 6/1960 | Switzerland | 417/423.3 |

*Primary Examiner*—Michael Koczo
*Assistant Examiner*—Robert N. Blackmon
*Attorney, Agent, or Firm*—John J. Posta, Jr.

[57] ABSTRACT

A device for use as a convenient, easy-to-use, and inexpensive pump for pumping water is disclosed which uses water pressure from a standard garden hose connected from a tap to the pump apparatus as the motive power to pump between seven and eleven times the volume of the water from the garden hose from a reservoir into a discharge hose which is any of several different standard sizes and which is connected to the pump apparatus. The water from the garden hose flows into the pump through a pump inlet having a reduced diameter venturi, which increases the velocity of the water, into a pumping chamber with the resulting drop in pressure creating a vacuum in the pumping chamber. The vacuum in the pressure chamber draws water from a reservoir the pump is placed in through a reservoir inlet chamber into the pumping chamber in the pump body, and the water exits the pumping chamber through a pump outlet located on the opposite side of the pumping chamber from the pump inlet.

2 Claims, 2 Drawing Sheets

WATER PRESSURE OPERATED WATER PUMP

BACKGROUND OF THE INVENTION

FIELD OF THE INVENTION

The present invention relates generally to a pump for pumping water, and more particularly to a convenient, easy-to-use, and inexpensive pump apparatus which uses water pressure from a standard garden hose connected from a tap to the pump apparatus as the motive power to pump between seven and eleven times the volume of the water from the garden hose from a reservoir into a discharge hose which is any of several different standard sizes and which is connected to the pump apparatus.

The number of applications for small, inexpensive utility pumps is virtually endless. As a few examples of applications for such pumps, consider their applications on construction sites and other industrial uses such as draining cisterns, furnace pits, window wells, or fountains. Other applications in a domestic setting are for draining pools or pool covers, basements, aquariums, ponds, washing machines, or backed-up sinks. There are numerous other applications such as for draining boats or standing water in any other location, with the usefulness of such pumps being limited only by the imagination of the user.

Typically, such utility pumps may be powered by electricity or by small, self-contained engines. The disadvantages of pumps including self-contained engines are immediately evident. Such pumps are expensive to purchase and are heavy, with their use being limited by the toxic fumes generated to outdoor applications. Their applications are generally industrial, with their application to domestic applications being limited by their aforesaid disadvantages.

Electrical pumps on the other hand are advantageous in that they are typically relatively inexpensive, and also small in size, therefore making them both convenient and highly portable. However, it will be realized by those skilled in the art that the combination of an electrically operated device and water is a potentially dangerous situation, and at the very least a situation to be used only with great caution due to the high potential of risk for serious injury involved Indeed, this drawback may result in the domestic application being resolved by manually removing the water, rather than in the more convenient but dangerous use of such an electrically operated pump.

Such manual operation may be accomplished in either of two ways. First, a number of mechanically operated pumps are available to pump water. Secondly, bailing using a pail is a manual technique of emptying a reservoir of water which is both convenient and does not require a pump. It will, however, be realized that these techniques represent arduous manual labor, and are simply not practical if there is a considerable amount of water to be removed, as is the case with a swimming pool for example.

It is therefore the objective of the present invention to provide a pump which is operated neither by a self-contained engine nor by electricity. The pump of the present invention must be operated instead by a medium which is not as dangerous as the use of electricity, but which is yet widely available, both in domestic and in commercial applications. The use of the selected medium to power a pump must also be convenient and easy to implement, not requiring an inordinate effort to operate the pump of the present invention.

In addition, the pump of the present invention must also be highly portable, preferably being of small size and light weight to be convenient both to use and to store when it is not in use. It must be inexpensive of construction to enable it to have the broadest possible market accessible to it, and also inexpensive to use and easy to operate to enable it to fit virtually any domestic or commercial application. It must also be absolutely safe to use, and should have as removing parts as possible to have a long operating life.

It should also have the advantage of being useable with any of the several different standard sizes of discharge hose which are both available and in wide use It is an objective that the pump of the present invention operate with a one and one-quarter inch or one and one-half inch discharge hose, as well as with a standard garden hose being used as the discharge hose. Finally, it is desirable that the pump of the present invention provide all of the aforesaid advantages and objectives without resulting in any significant disadvantage.

SUMMARY OF THE INVENTION

The disadvantages and limitations of the background art discussed above are overcome by the present invention. With this invention, a small, inexpensive pump is operated by water pressure from a conventional water tap using a garden hose connected between the water tap and the pump. A discharge hose is then attached to the pump, and the pump is submerged in the reservoir of water to be pumped. The water from the water tap is turned on, and the pressure of the water from the water tap will result in between seven and eleven times the volume of water from the water tap being pumped from the reservoir of water to be pumped.

The pump itself is molded of high impact plastic or a like material, and in the preferred embodiment has a hollow base with notches around the bottom edge thereof through which water is drawn into the pump. This enables water in the reservoir being pumped to be pumped down to within approximately one-eighth of an inch of the bottom surface of the reservoir. The hollow interior of the base communicates via a reservoir inlet aperture with a pumping chamber within the pump body.

The pump has, in addition to the reservoir inlet aperture, a pump inlet and a pump outlet which are in fluid communication with the pumping chamber within the pump body. The pump inlet includes a reduced diameter venturi which serves to greatly increase the velocity of water flowing under pressure from the water tap through the garden hose to the pump to the pump inlet on the wide side of the venturi. The pump outlet from the pump body is located on the opposite side of the pumping chamber from the pump inlet, with the reservoir inlet aperture being located on the side of the pumping chamber intermediate the pump inlet and the pump outlet.

When the water from the water tap flows under pressure through the venturi into the pumping chamber, the velocity of the water is greatly increased by the reduced diameter of the venturi. There is a corresponding drop in pressure according to Bernoulli's principle, and the pressure in the pumping chamber will be less than the pressure of the water in the reservoir. Accordingly, the water in the reservoir will be drawn through the hollow base and the reservoir inlet aperture into the pumping chamber.

Both the water entering the pump from the inlet and the water entering the pump from the reservoir inlet aperture will be pumped out of the pump through the pump outlet. As such, it may be appreciated that the pump of the present invention will operate to pump water from a reservoir using only water supplied under pressure from a water tap In fact, in the preferred embodiment the pump will pump seen to eleven times the water supplied from the water tap.

In the preferred embodiment of the pump of the present invention, there is a slight reduction in flow area at the pump outlet to tune the pump for optimum operating efficiency. An alternate embodiment of the pump of the present invention does not have the base portion, and is essentially comprised of the pump body alone, with a reservoir inlet aperture on the side of the pump body being used to draw water into the pumping chamber from the water reservoir.

In an additional aspect, the pump of the present invention is designed to accommodate a one and one-quarter inch or one and one-half inch discharge hose, either of which may be attached to the pump outlet. In addition, an adapter may be screwed into the pump outlet so that a standard garden hose may be attached to the pump outlet. This aspect of the pump design ensures that any of these three most common hose sizes may be used in conjunction with the pump of the present invention.

It is therefore apparent that the pump of the present invention is advantageously operated by water pressure from a tap, and as such requires neither a self-contained engine nor electricity to operate it. The pump of the present invention therefore is operated by a medium which is substantially safer than the use of electricity, but which medium is yet widely available, both in domestic and in commercial applications. The use of water pressure from a tap to power the pump of the present invention is also convenient and easy to implement, and does not require an inordinate effort to operate the pump.

In addition, the pump of the present invention is also highly portable, being of small size and light weight to be both convenient to use and easy to store when it is not in use. It is inexpensive of construction to enable it to have the broadest possible market accessible to it, and is also inexpensive to use and easy to operate, thereby enabling it to fit virtually any domestic or commercial application The pump of the present invention is also absolutely, safe to use, and has no moving parts at all, thus giving it a long operating life.

The pump of the present invention also has the advantage of being useable with any of the several different standard sizes of discharge hose available. It will operate with a one and one-quarter inch or one and one-half which discharge hose, as well as with a standard garden hose being used as the discharge hose. Finally, the pump of the present invention provides all of the aforesaid advantages and objectives without resulting in any significant disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 2:
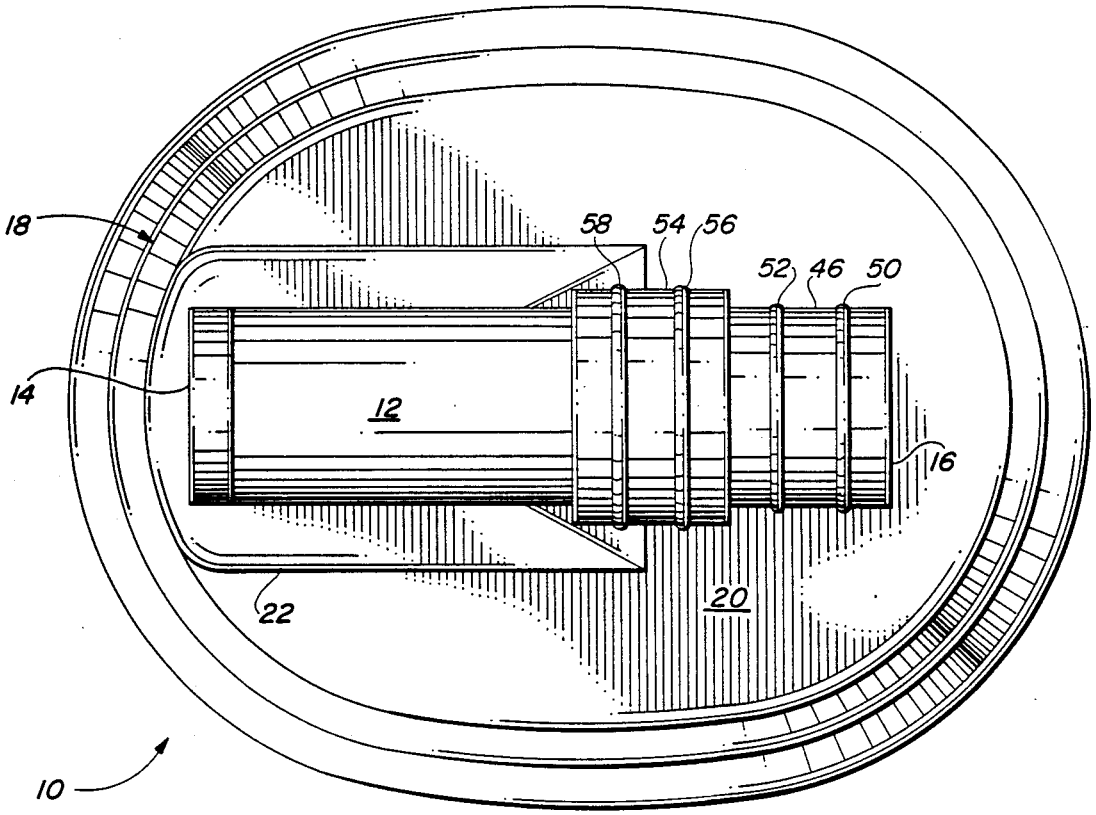
FIG. 2 is a top plan view of the pump shown in FIG. 1.
Figure 3:
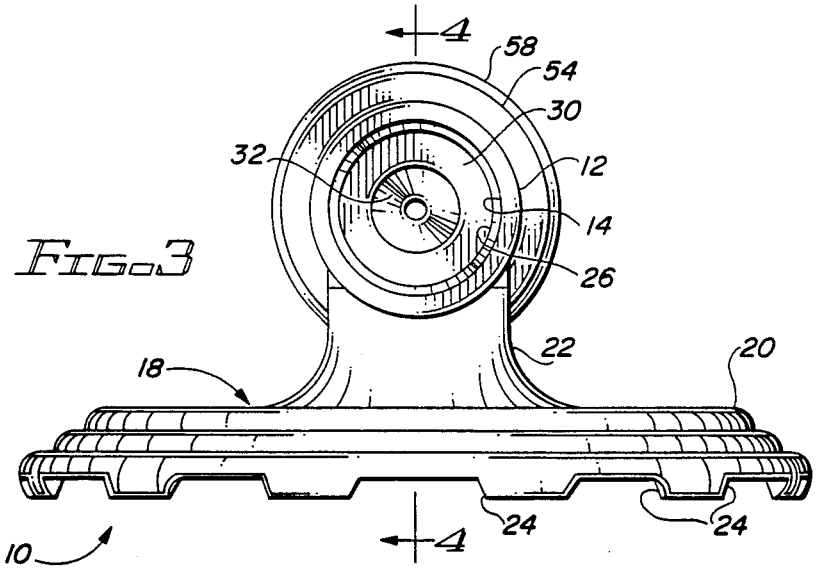
FIG. 3 is an end view of the pump shown in FIGS. 1 and 2 from the end of the pump on which the inlet is mounted.
Figure 4:
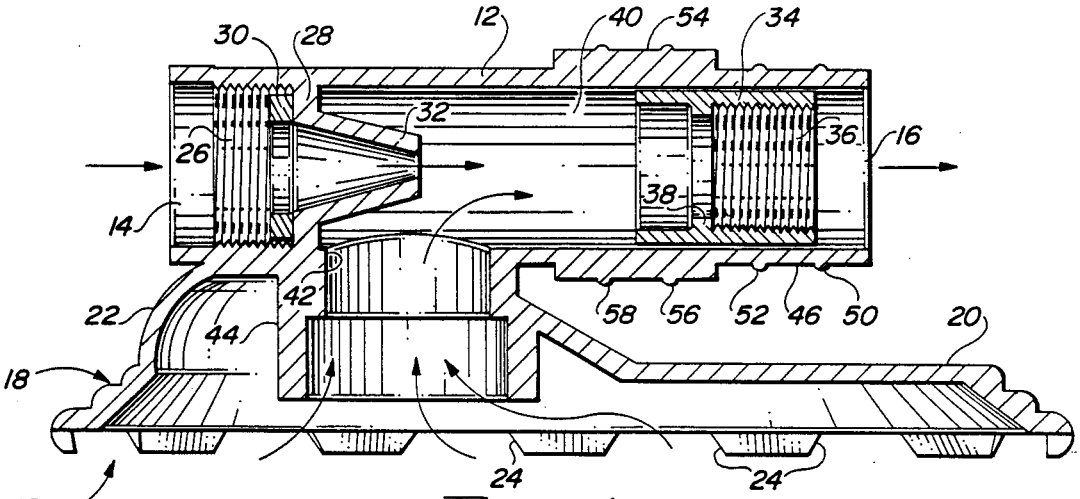
FIG. 4 is a side cutaway view of the pump shown in FIGS. 1 through 3 showing the reduced diameter venturi and the pumping chamber.

The preferred embodiment of the present invention is illustrated in FIGS. 1 through 4, in which a pump 10 is shown to have two main components. The first of these components is an essentially cylindrical pump body 12, which has a pump inlet 14 at one end thereof and a pump outlet 16 at the other end thereof. The end of the pump body 12 having the pump inlet 14 therein shall be referred to as the inlet end of the pump body 12, and the end of the pump body 12 having the pump outlet 16 therein shall be referred to as the outlet end of the pump body 12. The other component is a hollow base 18, which includes a hollow oval-shaped footing member 20 open on the bottom thereof as shown in FIG. 4, and a neck member 22 located on the top of the oval-shaped footing member 20 and at one end thereof.

The pump body 12 is mounted in the neck member 22 near the end of the pump body 12 in which the pump inlet 14 is located. The pump body 12 is located essentially parallel to the bottom of the oval-shaped footing member 20, with the pump body 12 extending over the oval-shaped footing member 20. The oval-shaped footing member 20 is designed to be placed on the bottom of a reservoir (not shown) containing water to be pumped, and the configuration of the oval-shaped footing member 20 is intended to grant the pump 10 stable footing.

The oval-shaped footing member 20 has a plurality of notches 24 around the sides at the bottom thereof, which notches 24 are designed to admit water into the interior of the hollow oval-shaped footing member 20. The notches 24 are approximately one-eighth of an inch high in the preferred embodiment, thereby allowing the pump 10 to draw water into the interior of the hollow oval-shaped footing member 20 down to a water level of one-eighth of an inch above the bottom surface of the reservoir on which the oval-shaped footing member 20 of the pump 10 is placed.

Referring now primarily to FIGS. 3 and 4, the construction of the pump inlet 14 may be detailed. The interior of the pump inlet 14 has a female threaded portion 26 therein, which female threaded portion 26 is of a size and pitch to accept the male end of a standard garden hose (not shown). Located on the interior of the pump body 12 on the side of the female threaded portion 26 nearer the outlet end of the pump body 12 is an annular wall 28. Situated on the side of the annular wall 28 facing the inlet end of the pump body 12 is a sealing washer 30, which may be made of rubber, soft plastic, or another elastomeric material. The sealing washer 30 functions to seal the male connector of the garden hose (not shown) when it is screwed into the female threaded portion 26 in the pump inlet 14 in the pump body 12.

Mounted on the side of the annular wall 28 facing the outlet end of the pump body 12 is a funnel-shaped reduced diameter venturi 32 which is in fluid communication with the pump inlet 14 through the center of the annular wall 28. The reduced diameter end of the reduced diameter venturi 32 is directed toward the outlet end of the pump body, 12, and is centrally located in the cross section of the pump body 12. The reduced diameter venturi 32 serves to greatly increase the velocity (and decrease the pressure) of water flowing under pressure from the pump inlet 14 through the reduced diameter end of the reduced diameter venturi 32.

Located in the interior of the pump outlet 16 is a hollow cylindrical insert 34 which is glued or otherwise affixed in place near the outlet end of the pump body 12. The end of the hollow cylindrical insert 34 nearer the outlet end of the pump body 12 has a female threaded portion 36 on the interior thereof. Also located in the interior of the hollow cylindrical insert 34 on the side of the female threaded portion 36 nearer the inlet end of the pump body 12 is an annular ring 38 which, together with the hollow cylindrical insert!34 itself, serves to slightly narrow the aperture through the outlet end of the pump body 12. This annular ring 38 is necessary to optimize the efficiency of the pump 10.

Located in the interior of the pump body 12 between the annular wall 28 and the annular ring 38 is a pumping chamber 40. The reduced diameter venturi 32 extends into the pumping chamber 40 on the end of the pumping chamber 40 nearer the inlet end of the pump body 12. It will be appreciated that the pump outlet 16 is located on the opposite end of the pumping chamber 40 from the pump inlet 14, so water flowing in the pump body 12 from the pump inlet 14 will floW across the pumping chamber 40 from the end nearer the inlet end of the pump body 12 to the end nearer the outlet end of the pump body 12.

The pump 12 also has an additional inlet for water which inlet is in fluid communication with the pumping chamber 40; this additional inlet is the reservoir inlet aperture 42. The reservoir inlet aperture 42 is located on the side of the pumping chamber 40 adjacent the annular wall 28. Accordingly, the reservoir inlet aperture 42 is located in the side of the pumping chamber 40 nearer the inlet end of the pump body 12 than the outlet end of the pump body, 12. It will also be noted that the reduced diameter venturi 32 extends past approximately half of the reservoir inlet aperture 42 toward the outlet end of the pump body 12.

The remaining segment of the interior design of the pump 10 is utilized to convey water from the interior of the oval-shaped footing member 20 into the pumping chamber 40. A hollow, essentially cylindrical segment 44 is mounted in the interior of the top of the neck member 22 of the hollow base 18. The top of the cylindrical segment 44 is in fluid communication through the reservoir inlet aperture 42 with the pumping chamber 40. The bottom of the cylindrical segment 44 extends downwardly into the oval-shaped footing member 20, and is open to allow water to be drawn into it. The hollow interior of the hollow base 18 thus communicates via the cylindrical segment 44 and the reservoir inlet aperture 42 with the pumping chamber 40 within the pump body 12.

The cylindrical segment 44 does not extend down to the bottom of the oval-shaped footing member 20, thereby preventing the bottom of the cylindrical segment 44 from abutting the surface the pump 10 is placed upon and being blocked. Note that the interior of the cylindrical segment 44 has a reduced diameter on the end communicating with one pumping chamber 40. This causes water flowing through the cylindrical segment 44 into the pumping chamber 40 to increase in velocity (and decrease in pressure).

The construction of the pump 10 is of high impact plastic material in the preferred embodiment, with the pump body 12 and the hollow base 18 being molded in unitary fashion in a single step. The hollow cylindrical insert 34 may then be glued or otherwise fastened to the interior of the outlet end of the pump body 12, and the sealing washer 30 inserted into the inlet end of the pump body 12 to complete the assembly of the pump 10 of the present invention. It should be noted that the hollow cylindrical insert 34 may also be molded together with the pump body 12 and the hollow base 18, although this makes the molding process considerably more difficult. In the preferred embodiment it is fabricated separately to enhance the ease of manufacture of the pump 10.

In an additional aspect, the pump 10 of the present invention is designed to accommodate several different sizes of discharge hose (none of which are shown herein). Specifically, the outer diameter of the pump body 12 of the pump 10 is specially designed to allow either a one and one-quarter inch inside diameter hose (not shown) or a one and one-half inch inside diameter discharge hose (not shown) to be attached to the pump outlet 16. These two hose sizes represent two popular utility hose sizes, with a one and one-half inch inside diameter discharge hose commonly being used as a swimming pool utility hose.

Figure 1:
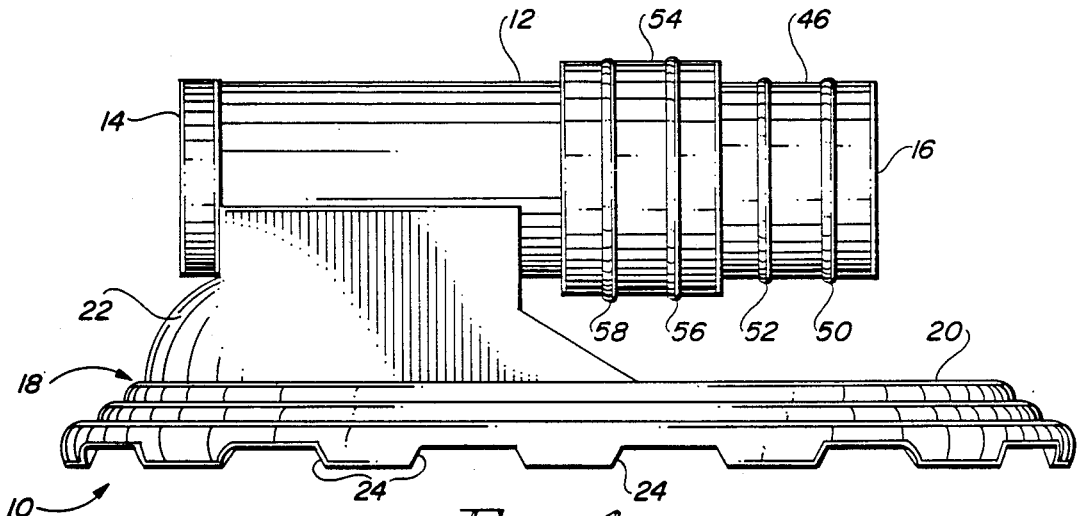
FIG. 1 is a side view of the pump of the present invention, showing the pump inlet and pump outlet to the pump body and the notches in the pump base used to draw water from the reservoir to be drained by the pump.

Referring particularly, to FIGS. 1 and 2, the outer diameter of the outlet end of the pump body 12 is made to accept either of the two hose sizes mentioned above. A portion 46 of the pump body 12 immediately adjacent the outlet end of the pump body 12 has an outer diameter just smaller than one and one-quarter inches. Located circumferentially around the portion 46 of the pump body 12 immediately adjacent the outlet end of the pump body 12 are two spaced apart raised beads 50 and 52. When the end of a one and one-quarter inch inside diameter hose (not shown) is pushed over the portion 46 of the pump body 12 immediately adjacent the outlet end of the pump body 12 and the two raised beads 50 and 52, the to raised beads 50 and 52 will engage the interior of the end of the one and one-quarter inch inside diameter hose in an interference type fit for a sealing relationship.

Similarly, a portion 54 of the pump body 12 toward the inlet end of the pump body 12 from and adjacent to the portion 46 of the pump body 12 immediately adjacent the outlet end of the pump body 12 has an outer diameter just smaller than one and one-quarter inches. Located circumferentially around the portion 54 of the pump body 12 toward the inlet end of the pump body 12 from and adjacent to the portion 46 of the pump body 12 are two spaced apart raised beads 56 and 58. When the end of a one and one-half inch inside diameter hose (not shown) is pushed over the portion 54 of the pump body 12 toward the inlet end of the pump body 12 from and adjacent to the portion 46 of the pump body 12 and the two raised beads 56 and 58, the two raised beads 56 and 58 will engage the interior of the end of the one and one-half inch inside diameter hose in an interference type fit for a sealing relationship.

Figure 5:
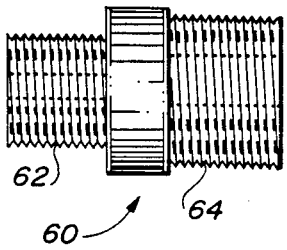
FIG. 5 is a side view of an adapter used in the pump outlet of the pump shown in FIGS. 1 through 4 to allow a standard garden hose to be attached to the pump outlet.

In addition, an adapter 60 such as the one shown in FIG. 5 may be screwed into the female threaded portion 36 in the pump outlet 16 so that a standard garden hose (not shown) may be attached to the pump outlet 16. The adapter 60 has a first male threaded portion 62, which is designed to engage the female threaded portion 36 in the pump outlet 16. The adapter 60 also has a second male threaded portion 64, designed to engage the female end of a standard garden hose (not shown). The adapter 60 has an aperture (not shown) extending therethrough.

This aspect of the design of the pump 10 ensures that any of these three most common hose sizes may be used in conjunction with the pump 10 of the present invention. This novel arrangement enables the pump 10 to be used with the different size hoses with a high degree of utility.

The operation of the pump 10 of the present invention may now be described, with particular reference being made to FIG. 4. The pump 10 is operated by water pressure from a conventional water tap (not shown) using a garden hose (not shown) connected between the water tap and the pump 10. The male end of the garden hose (not shown) is fastened to the water tap, and the female end of the water hose (not known) may then be screwed into the female threaded portion 26 in the pump inlet 14. A discharge hose which may be any of the three sizes described above (not shown) is then attached to the pump outlet 16, and the pump 10 is submerged in the reservoir of water (not shown) to be pumped.

The water from the water tap not shown) is then turned on, and the pressure of the water from the water tap will result in between seven and eleven times the volume of water from the water tap being pumped from the reservoir of water to be pumped. The water initially enters the pump inlet 14, and flows to and through the reduced diameter venturi 32. When the water from the water tap flows under pressure through the reduced diameter venturi 32 into the pumping chamber 40, the velocity of the water is greatly increased by the reduced diameter of the venturi.

There is according a drop in pressure in the pumping chamber 40 according to Bernoulli's principle, with the pressure in the pumping chamber 40 being less that the pressure of the water in the reservoir (which is as a minimum at ambient atmospheric pressure). Accordingly, the water in the reservoir will be drawn through the hollow base 18, the cylindrical segment 44, and the reservoir inlet aperture 42 into the pumping chamber 40.

Both the water entering the pumping chamber 40 from the pump inlet 14 and the water entering the pumping chamber 40 from the reservoir inlet aperture 42 will be pumped out of the pumping chamber 40 through the pump outlet 16. As such, it may be appreciated that the pump 10 of the present invention will operate to pump fluid using only water supplied under pressure from a water tap. In fact, in the preferred embodiment the pump 10 will pump seven to eleven times the water supplied from the water tap.

Figure 6:
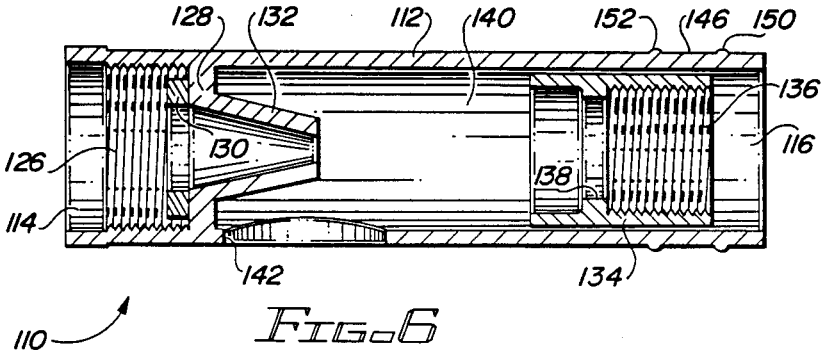
FIG. 6 is a side cutaway view of an alternate embodiment pump not having a pump base.

An alternate embodiment of the pump of the present invention does not have the hollow base 18, and is essentially comprised of the pump body 12 alone. Referring now to FIG. 6, a pump 110 is illustrated which pump 110 is comprised of an essentially cylindrical pump body 112, which has a pump inlet 114 at one end thereof and a pump outlet 116 at the other end thereof. The end of the pump body 112 having the pump inlet 114 therein shall be referred to as the inlet end of the pump body 112, and the end of the pump body 112 having the pump outlet 116 therein shall be referred to as the outlet end of the pump body 112.

The interior of the pump inlet 114 has a female threaded portion 126 therein, which female threaded portion 126 is of a size and pitch to accept the male end of a standard garden hose (not shown). Located on the interior of the pump body 112 on the side of the female threaded portion 126 nearer the outlet end of the pump body 112 is an annular wall 128. Situated on the side of the annular wall 128 facing the inlet end of the pump body 112 is a sealing washer 130, which may be made of rubber, soft plastic, or another elastomeric material. The sealing washer 130 functions to seal the male connector of the garden hose (not shown) when it is screwed into the female threaded portion 126 in the pump inlet 114 in the pump body 112.

Mounted on the side of the annular wall 128 facing the outlet end of the pump body 112 is a funnel-shaped reduced diameter venturi 132 which is in fluid communication with the pump inlet 114 through the center of the annular wall 128. The reduced diameter end of the reduced diameter venturi 132 faces the outlet end of the pump body 112, and is centrally located in the cross section of the pump body 112. The reduced diameter venturi 132 serves to greatly increase the velocity (and decrease the pressure) of water flowing under pressure from the pump inlet 114 through the reduced diameter end of the reduced diameter venturi 132.

Located in the interior of the pump outlet 116 is a hollow cylindrical insert 134 which is glued or otherwise affixed in place near the outlet end of the pump body 112. The end of the hollow cylindrical insert 134 near the outlet end of the pump body 112 has a female threaded portion 136 on the interior portion thereof. Also located in the interior of the hollow cylindrical insert 134 on the side of the female threaded portion 136 nearer the inlet end of the pump body 112 is an annular ring 138 which, together with the hollow cylindrical insert 134 itself, serves to slightly narrow the aperture through the outlet end of the pump body 112. This annular ring 138 is necessary to optimize the efficiency of the pump 110.

Located in the interior of the pump body 112 between the annular wall 128 and the annular ring 138 is a pumping chamber 140. The reduced diameter venturi 132 extends into the pumping chamber 140 on the end of the pumping chamber 140 nearer the inlet end of the pump body 112. It will be appreciated that the pump outlet 116 is located on the opposite end of the pumping chamber 140 from the pump inlet 114, so water flowing in the pump body 112 from the pump inlet 14 will flow across the pumping chamber 140 from the end nearer the inlet end of 112 to the end nearer the outlet end of the pump body 112.

The pump 112 also has an additional inlet for water which inlet is in fluid communication with the pumping 140; this additional inlet is the reservoir inlet aperture 142. The reservoir inlet aperture 142 is located on the of the pumping chamber 140 adjacent the annular wall 128, and extends through the side of the pump body 112. Accordingly, the reservoir inlet aperture 142 is located in the of the pumping chamber 140 nearer the inlet end of the body 112 than the outlet end of the pump body 112. It will be noted that the reduced diameter venturi 132 extends past approximate half of the reservoir inlet aperture 142 toward the outlet end of the pump body 112.

The outer diameter of the outlet end of the pump 112 is made to accept a one and one-quarter inch inside diameter hose (not shown). A portion 146 of the pump body 112 immediately adjacent the outlet end of the pump body 112 has an outer diameter just smaller than one and one-quarter inches. Located circumferentially around the portion 146 of the pump body 112 immediately adjacent the outlet end of the pump body 112 are two spaced apart raised beads 150 and 152. When the end of a one and one-quarter inch inside diameter hose is pushed over portion 146 of the pump body 112 immediately adjacent the outlet end of the pump body 112 and the two raised beads 150 and 152, the two raised beads 150 and 152 will engage the interior of the end of the one and one-quarter inch inside diameter hose in an interference type fit for a sealing relationship.

In addition, an adapter 60 such as the one shown in FIG. 5 may be screwed into the female threaded portion 136 in the pump outlet 116 so that a standard garden hose (not shown) may be attached to the pump outlet 116. The first male threaded portion 62 of the adapter 60 is screwed into the female threaded portion 136 in the pump outlet 116.

The pump 10 is operated by water pressure from a conventional water tap (not shown) using a garden hose (not shown) connected between the water tap and the pump 110. The male end of the garden hose (not shown) is fastened to the water tap, and the female end of the water hose (not shown) may then be screwed into the female threaded portion 126 in the pump inlet 114. A discharge hose which may be either of the two sizes described above (not shown) is then attached to the pump outlet 116, and the pump 110 is submerged in the reservoir of water (not shown) to be pumped. The water from the water tap (not shown) is then turned on, and the pressure of the water from the water tap will result in between seven and eleven times the volume of water from the water tap being pumped from reservoir of water to be pumped.

It is thus apparent from the above discussion of the preferred embodiment of the pump of the present invention that it is advantageously operated by water pressure from a tap, and as such requires neither a self-contained engine nor electricity to operate it. It is accordingly oberated by a medium which is substantially safer than the use of electricity, but which medium is yet widely available, both domestic and in commercial applications. The use of water pressure from a tap to power the pump is also both convenient and easy to implement, and does not require an inordinate effort to set up or operate the pump.

In addition, the pump of the present invention is of small size and light weight, and is thus highly portable as well as being both convenient to use and easy to store when it is not in use. It is inexpensive of construction to enable it to have the broadest possible market accessible to it, and is also inexpensive to use and easy to operate, thereby enabling it to fit virtually any domestic or commercial application. The pump of the present invention is also safe to use, and has no moving parts at all to give it a long operating life.

The pump of the present invention also has the advantage of having an output portion which may be connected to any of the several different standard sizes of discharge hose available. It will operate with a one and one-quarter inch or one and one-half inch discharge hose, as well as with a standard garden hose being used as the discharge hose. Finally, the pump of the present invention provides all of the aforesaid advantages and objectives without resulting in any significant disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A pump for pumping water from a reservoir through an outlet hose, comprising:

(a) an essentially cylindrical pump body having an inlet end and an outlet end, said inlet end for connection to a source of water under pressure, said outlet end for connection to said outlet hose;

(b) an annular wall located in said cylindrical pump body nearer said inlet end of said cylindrical pump body than said outlet end of said cylindrical pump body;

(c) a reduced diameter venturi mounted in the interior of said cylindrical pump body and located near said inlet end of said cylindrical pump body, the reduced diameter end of said reduced diameter venturi being directed toward said outlet end of said cylindrical pump body, wherein said reduced diameter venturi is mounted on the side of said annular wall facing said outlet end of said cylindrical pump body, said reduced diameter venturi being in fluid communication with said inlet end of said cylindrical pump body through the center of said annular wall;

(d) a hollow cylindrical insert affixed in place in the interior of said cylindrical pump body near said pump outlet, said cylindrical insert for restricting the flow through said cylindrical pump body, said cylindrical insert including an annular ring located centrally therein which, together with said cylindrical insert itself, serves to slightly narrow the aperture through said cylindrical pump body near said outlet end thereof;

(e) a pumping chamber located in said cylindrical pump body between said reduced diameter venturi and said restricting means;

(f) a reservoir inlet aperture located in the side of said cylindrical pump body, said reservoir inlet aperture being in fluid communication with said pumping chamber, said reservoir inlet aperture for allowing water in said reservoir to be drawn into said pumping chamber and out of said pump through said outlet hose;

(g) a hollow base, said cylindrical pump body being mounted on said hollow base, the interior of said hollow base being in fluid communication with said reservoir inlet aperture in said cylindrical pump body;

(h) wherein said hollow base comprises:

(1) a hollow oval-shaped footing member open on the bottom thereof, wherein said oval-shaped footing member has a plurality of notches around the sides at the bottom thereof, which notches are designed to admit water into the interior of said hollow oval-shaped footing member;

(2) a neck member located on the top of said oval-shaped footing member and at one end thereof, said cylindrical pump body being mounted on said neck member near the end of said cylindrical pump body having said pump inlet; and (3) a hollow, essentially cylindrical segment mounted in the interior of said neck member, the top of said cylindrical segment being in fluid communication through said reservoir inlet aperture with said pumping chamber, the bottom of said cylindrical segment extending downwardly into said oval-shaped footing member, and being open to allow water to be drawn into it.

2. A pump as defined in claim 1, wherein said notches are approximately one-eighth of an inch high, thereby allowing said pump to draw water into the interior of said hollow oval-shaped footing member down to a water level of one-eighth of an inch above the bottom surface of the reservoir on which said oval-shaped footing member is placed.

* * * * *